US006547153B1

(12) United States Patent
Davis

(10) Patent No.: US 6,547,153 B1
(45) Date of Patent: Apr. 15, 2003

(54) HEATING AND COOLING SYSTEM USING FRICTIONAL AIR HEATING

(76) Inventor: Maxie C. Davis, 636-B Walnut St., Statesville, NC (US) 28677

( * ) Notice: Subject to any disclaimer, the term of this patent is extended or adjusted under 35 U.S.C. 154(b) by 0 days.

(21) Appl. No.: 09/697,224

(22) Filed: Oct. 26, 2000

(51) Int. Cl.[7] ..... F24D 3/08

(52) U.S. Cl. ..... 237/19; 237/8 R; 237/12.1; 126/247

(58) Field of Search ..... 237/19, 69, 2 B, 237/12.1; 122/26; 126/21 A, 247; 165/156

(56) References Cited

U.S. PATENT DOCUMENTS 1,682,102 A * 8/1928 Allen ..... 122/26
3,278,122 A * 10/1966 Laing ..... 165/156
3,481,322 A * 12/1969 Hokanson, Sr. et al. ..... 122/26
4,361,009 A * 11/1982 Schluderberg ..... 60/659
5,226,593 A * 7/1993 Beryozkin et al. ..... 237/1 R
5,881,953 A * 3/1999 Moroi et al. ..... 237/12.3 R

* cited by examiner

*Primary Examiner*—Derek Boles
(74) *Attorney, Agent, or Firm*—Adams, Schwartz & Evans, P.A.

(57) ABSTRACT

A frictional heating system for communicating with an air supply duct to heat and cool air in a building, including an enclosure defining an interior, two air inlets, and at least one air outlet therein communicating with the interior of the enclosure for permitting air flow therethrough. A plurality of turbines are carried on a common shaft for rotation therewith. Each of the turbines is positioned within the enclosure for drawing air into the enclosure and frictionally heating the air therein. A first conduit is in fluid communication with the air outlet, a water heater and an air conditioning system, for moving frictionally-heated air from the air outlet to one or the other of the water heater and the air conditioning system. A motor assembly including a motor is operatively connected to the common shaft and positioned outside the enclosure for driving the common shaft and turbines.

16 Claims, 7 Drawing Sheets

HEATING AND COOLING SYSTEM USING FRICTIONAL AIR HEATING

TECHNICAL FIELD AND BACKGROUND OF THE INVENTION

This invention relates to a frictional heating assembly for use with a heating and cooling system, and a water heater. In particular, the application discloses a frictional heating system wherein enhanced heating efficiency and operation is achieved by sequentially passing air through multiple turbine housings. A rotating turbine is positioned in each of the turbine housings. The turbines generate mechanical energy during operation which is converted into heat energy that heats the air passing through the housings.

Prior art patents disclose the concept of frictionally heating air by using a single turbine which is driven by a motor positioned together within the same enclosure in which the air is frictionally heated. Placing the motor and turbine together within such a confined space can cause the motor to overheat, which not only severely impairs the performance of the prior art frictional heating devices, but also drastically shortens the overall life of the motors. Furthermore, using only one turbine within a single enclosure compromises the efficiency of prior art devices by limiting the extent to which the temperature of the air passing through the enclosure can be increased.

The invention of the present invention addresses these and other problems present in prior art devices by providing a frictional heating assembly having a unique motor and turbine assembly. Unlike prior art devices which confine the motor that drives the turbine within the same housing in which the turbine resides, the motor used in the frictional heating assembly of the present application is positioned within a separate air supply duct located outside of the enclosure in which the turbines are positioned. Placing the motor inside the air supply duct allows it to be cooled by ambient air from the building or other structure in which the heating assembly is being used.

The frictional heating assembly of the present application does not rely solely upon a single turbine to frictionally heat the air. The single motor is instead operatively connected to a single common shaft upon which multiple turbines and an intake fan are positioned. The turbines are each positioned within individual housings which are contained within a single enclosure. The turbines are selectively utilized to frictionally heat air which is introduced within the interior of the enclosure and housings. The intake fan is positioned within the air supply duct upstream from the motor and outside of the enclosure in which the turbines are located. This energy-efficient arrangement prevents the motor from overheating, permits the motor to drive the intake fan for drawing ambient air through the air supply duct while simultaneously driving the turbines inside the enclosure, and results in air which is frictionally heated to temperatures much higher than those previously achieved using prior art devices.

SUMMARY OF THE INVENTION

Therefore, it is an object of the present invention to provide a frictional heating system which utilizes a motor positioned outside of the enclosure in which air is frictionally heated so that the motor does not overheat from being subjected to the heat generated inside the enclosure during the heating process.

It is another object of the invention to provide a frictional heating system within which the air moving therethrough is maintained at a substantially constant pressure while the frictional heating system is in operation.

It is another object of the present invention to provide a frictional heating system which efficiently utilizes a single motor to simultaneously operate not only the turbines used to frictionally heat air inside the heating assembly, but also an intake fan used to draw ambient air from a building through a heating and cooling system used in conjunction with the frictional heating system.

It is another object of the present invention to provide a frictional heating system which uses a conduit system which interconnects the air-cooling condenser coil of a conventional cooling system in a manner such that the heat generated from the condenser coil during operation is directed back into the cooling system and efficiently utilized, thereby permitting the condenser coil to be completely enclosed within the interior of a building rather than having to be positioned outside of the building so that the heat generated by the condenser coil can dissipate into the open air.

It is another object of the invention to provide a frictional heating system which includes a plurality of turbines positioned in individual turbine housings in which air is frictionally heated, wherein the passage of the air through the turbine housings changes in sequence depending upon the extent to which the temperature of the air is to be increased.

These and other objects of the present invention are achieved in the preferred embodiments disclosed below by providing a frictional heating system which communicates with an air supply duct to heat and cool air in a building. The frictional heating system includes an enclosure defining an interior, two air inlets, and at least one air outlet therein communicating with the interior of the enclosure for permitting air flow therethrough. A plurality of turbines are carried on a common shaft for rotation therewith. Each of the turbines is positioned within the enclosure for drawing air into the enclosure and frictionally heating the air therein. A motor assembly is operatively connected to the common shaft and positioned outside the enclosure for driving the common shaft and turbines mounted thereon. A first conduit is in fluid communication with the air outlet, water heater and air conditioning system for moving frictionally-heated air from the air outlet to one or the other of the water heater and the air conditioning system.

According to one preferred embodiment of the invention, a first directional valve is positioned in the first conduit for selectively moving frictionally-heated air from the air outlet to one or the other of the water heater and the air conditioning system.

According to another preferred embodiment of the invention, the improved frictional heating assembly further comprises a plurality of turbine housings positioned within the enclosure. Each of the turbine housings defines an interior in fluid communication with the air inlet for permitting air to flow into the turbine housings and with the air outlet for permitting the air to flow out of the turbine housings. Each of the turbines is positioned within a respective one of the turbine housings for drawing air into the respective turbine housing interior and frictionally heating the air therein.

According to yet another preferred embodiment of the invention, the motor assembly further comprises an intake fan mounted on the common shaft and positioned within the air supply duct for drawing ambient air therethrough.

According to yet another preferred embodiment of the invention, the motor is interconnected by a head and tail pulley assembly to the common shaft for driving the common shaft, turbines and intake fan, and is positioned upstream from the intake fan within the air supply duct for being cooled by the ambient air drawn therethrough.

According to yet another preferred embodiment of the invention, the frictional heating system further includes at least one turbine conduit selectively communicating with the plurality of turbine housings for directing air from the air inlet from an upstream side to a downstream side of each turbine housing to frictionally heat the air therein to a predetermined temperature.

According to yet another preferred embodiment of the invention, the frictional heating system further includes at least one recirculation conduit selectively communicating with the plurality of turbine housings for directing the air through the turbine housings and into the air outlet.

According to yet another preferred embodiment of the invention, each of the turbines includes a series of radially-extending vanes for creating and maintaining a flow of air within each turbine housing upon rotation of the turbine by the common shaft, thereby frictionally heating the air therein.

According to yet another preferred embodiment of the invention, each of the radially-extending vanes includes contoured edges for creating a vacuum inside each turbine housing upon rotation of the turbines by the common shaft, thereby increasing the rate at which the air is frictionally heated therein.

According to yet another preferred embodiment of the invention, the turbines frictionally heat the air to a temperature between 140° F. and 460° F.

According to yet another preferred embodiment of the invention, the frictional heating system further includes a heat exchanger for selectively precooling air before the air enters the air-cooling condenser coil or for preheating air before the air is returned to the enclosure. The heat exchanger is positioned within the air supply duct upstream from the motor assembly and defines an interior in fluid communication with an air intake conduit system fluidly connected the air outlet for receiving air therefrom.

According to yet another preferred embodiment of the invention, the interior of the heat exchanger is in fluid communication with an air outlet conduit system fluidly connected to and adapted for selectively directing air out of the heat exchanger to the air cooling condenser coil or to the air inlet of the enclosure.

According to yet another preferred embodiment of the invention, the air intake conduit system includes first and second intake conduits in fluid communication with an ambient air intake conduit for drawing ambient air into said heat exchanger and to the air outlet of the frictional heating assembly for receiving frictionally heated air therefrom.

According to yet another preferred embodiment of the invention, the air intake conduit system further includes an air intake filter positioned within the ambient air intake conduit for filtering the ambient air passing therethrough.

According to yet another preferred embodiment of the invention, the air intake conduit system further includes a second directional valve positioned within the ambient air intake conduit downstream from the air intake filter for selectively introducing ambient air into the first and second intake conduits.

According to yet another preferred embodiment of the invention, the air outlet conduit system includes a first return conduit including a third directional valve positioned therein for selectively directing air from said heat exchanger. The first return conduit and third directional valve selectively communicate with a first return duct connected to and in fluid communication with the air inlet for returning air to the enclosure, and an intake duct connected to and in fluid communication with the air cooling condenser coil in the air conditioning system for preheating the air. The air cooling condenser coil is connected to and fluidly communicates with a second return duct which is connected to the air inlet for returning the preheated air to the enclosure.

According to yet another preferred embodiment of the invention, the outlet conduit system further includes a second return conduit in fluid communication with said second return duct. The second return conduit includes a first dispatch valve positioned therein for selectively opening the second return conduit for permitting air to flow through the second return duct and into the air inlet, thereby returning the preheated air to the enclosure.

According to yet another preferred embodiment of the invention, the intake fan includes a clutch mechanism for selectively disengaging the fan from the motor assembly, thereby preventing the flow of ambient air through the air supply duct.

According to yet another preferred embodiment of the invention, the frictional heating assembly further includes a fourth directional valve positioned within the second return duct between the air-cooling condenser coil and the second return conduit for controlling the direction of air flowing through the second return duct.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
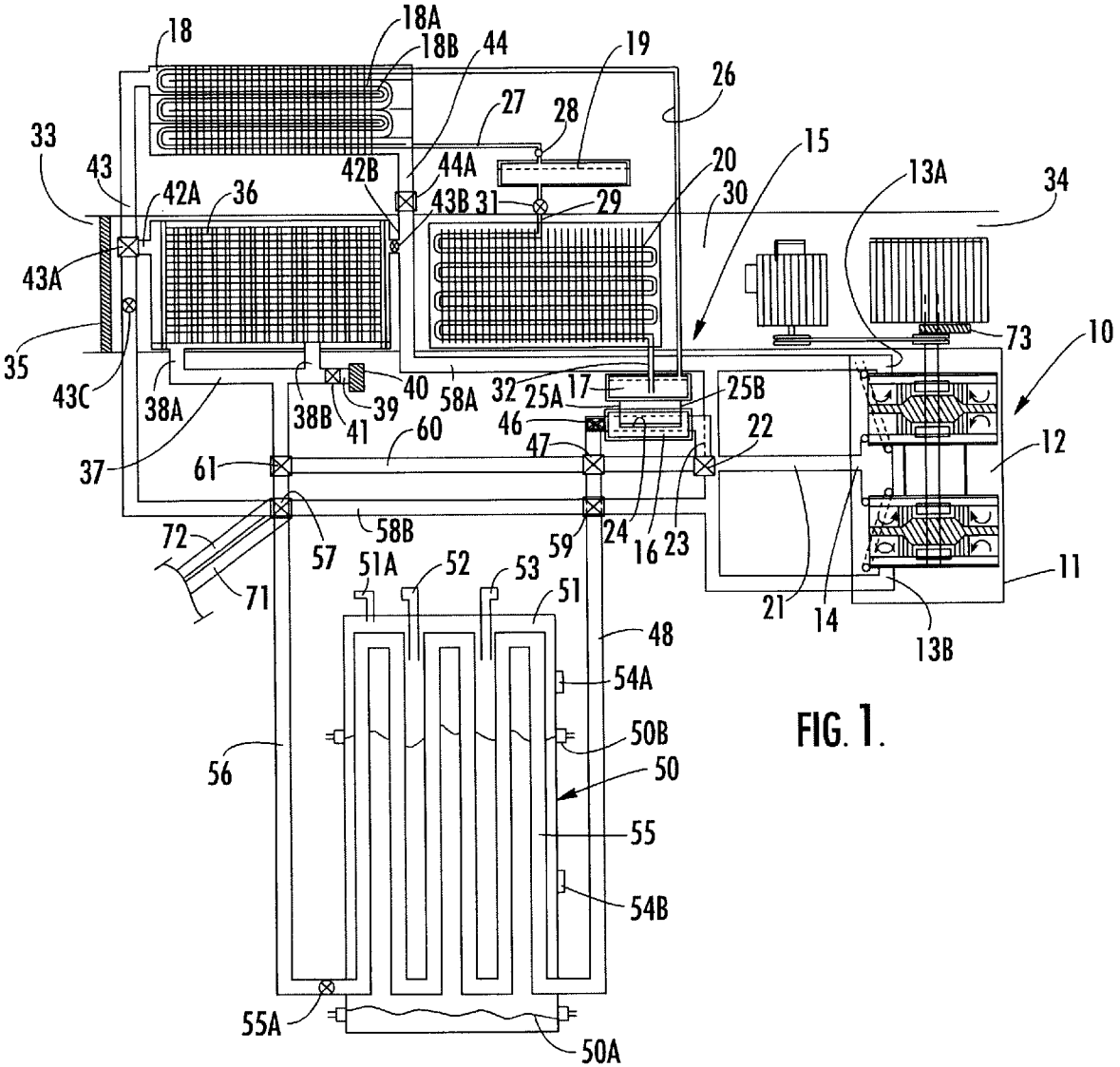
FIG. 1 is a schematic illustration of a frictional heating and cooling system according to one embodiment of the present invention.

Referring now to the drawings, a frictional heating and cooling system according to the present invention is illustrated in FIG. 1 and shown generally at reference numeral 10. The heating and cooling system 10 includes an enclosure 11 defining an interior 12, which is in fluid communication with air inlet manifolds 13A and 13B, and an air outlet manifold 14. Air is drawn through the air inlet manifolds 13A and 13B into the interior 12, and is discharged therefrom through the air outlet manifold 14 after being heated within the interior 12. As discussed in detail below, the air is heated within the interior 12 to a temperature of between 140° F. to 460° F., and is discharged from the enclosure 11 through the air outlet manifold 14 at a high volumetric rate. A number of dispatch and directional valves are positioned throughout the frictional heating and cooling system 10 and cooperate together to control the passage of air through the system 10 to ensure, among other things, that the system 10 does not overheat, and that the pressure inside the system 10 is maintained at no greater than 80 psi.

The frictional heating and cooling system 10 of the present invention is preferably used not only for heating water, but also for heating and cooling a building. As is shown in FIG. 1, the frictional heating and cooling system 10 operates in its cooling function by being used in conjunction with an absorption-type air conditioning system 15. The air conditioning system 15 includes an insulated first heat exchanger 16, a generator 17, two air-cooled condenser coils 18A and 18B positioned within a housing 18, a liquid receiver 19, and an evaporator coil 20. Heated air from the enclosure 11 passes through the air outlet manifold 14 and travels through a first duct 21. A valve 22 interconnects the first duct 21 with a second duct 23, which is in turn connected to the first heat exchanger 16. Although any suitable valve may be used, valve 22 is preferably a two-way directional valve.

Upon entry into the first heat exchanger 16, the heated air passes across a first conduit 24, which is in fluid communication with two identical connecting conduits 25A and 25B. A solution consisting of ammonia and water is sealed within the first conduit 24, and is heated by the air passing across the first conduit 24, which causes ammonia gas to be driven off of the solution. As the heated ammonia and water solution circulates through connecting conduits 25A and 25B between the first heat exchanger 16 and the generator 17, the ammonia gas continues to be generated and flows from the generator 17 through a second conduit 26 and into the two air-cooling condenser coils 18A and 18B. Once inside the condenser coils 18A and 18B, the ammonia gas is condensed into a liquid, which then passes along a third conduit 27 through a one-way check valve 28 into the liquid receiver 19. The liquid receiver 19 is connected by a fourth conduit 29 to the evaporator coil 20, which is positioned within an air supply duct 30.

An expansion valve 31 is positioned within fourth conduit 29. The liquid ammonia passes from the receiver 19 through the fourth conduit 29 and the expansion valve 31, where it is then directed into the evaporator coil 20. Upon passing through the expansion valve 31 and into the evaporator coil 20, the liquid ammonia absorbs heat and is converted back into a gas. The ammonia gas then passes from the evaporator coil 20 through a fifth conduit 32 back into the generator 17. Upon being returned to the generator 17, the ammonia gas recombines with the water and ammonia solution, is reheated by heated air passing across the first conduit 24, and undergoes the cycle described above in a repetitive manner.

As is shown in FIG. 1, the evaporator coil 20 is positioned within the air supply duct 30 between respective first and second openings 33 and 34, which are defined by the air supply duct 30. Ambient air from the building is drawn through a filter 35 which is positioned across the first opening 33, and then passes along the air supply duct 30 to the evaporator coil 20. Upon passing across the evaporator coil 20, the air is cooled, and is then directed down the air supply duct 30 back into the building through second opening 34.

The invention of the present application also includes a unique mechanism which "pre-cools" the air passing through the air supply duct 30 at a location upstream from the evaporator coil 20. As is shown in FIG. 1, a second heat exchanger 36 is positioned within the air supply duct 30 between the filter 35 and the evaporator coil 20. An ambient air intake pipe 37 is connected to the second heat exchanger 36 by first and second heat exchanger inlet conduits 38A and 38B. Intake pipe 37 defines an opening 39, which is covered by an air filter 40 through which ambient air passes prior to being introduced to the second heat exchanger 36. A directional valve 41 is positioned within the intake pipe 37 downstream from the opening 39 and filter 40 for controlling the flow of ambient air into the intake pipe 37. When the directional valve 41 is in an open position, ambient air passes into and through the intake pipe 37, through the respective first and second heat exchanger inlet conduits 38A and 38B, and into the second heat exchanger 36.

Once inside the second heat exchanger 36, the ambient air is used by the second heat exchanger 36 to "pre-cool" the air passing through the air supply duct 30 before the air encounters the first heat exchanger 20. The air inside the second heat exchanger 36 then passes through a heat exchanger outlet 42 and into a conduit 43. A directional valve 43A is positioned within conduit 43 and directs the pre-cooled air through conduit 43 and across the condenser coils 18A and 18B, where it cools the ammonia gas flowing through the condenser coils 18A and 18B, causing it to be condensed into a liquid. The pre-cooled air then exits the housing 18 and travels through a directional valve 44A, which is positioned within a conduit 44. Conduit 44 is in fluid communication with a first air return pipe 58A. The air travels along the first air return pipe 58A, and passes through the air inlet manifolds 13A and 13B into the enclosure 11, where it undergoes the frictional heating process again in a cyclical manner.

The air heated within the enclosure 11 may also be used to heat water while the air conditioning system 15 is simultaneously operating. As is shown in FIG. 1, after passing through the heat exchanger 16, the heated air is directed through valves 46 and 47, respectively, and through conduit 48, which fluidly communicates with a water heater shown generally at reference numeral 50. Valve 46 is preferably a vibrating dispatch valve which not only regulates the temperature, pressure, flow and direction of the air passing through the heat exchanger 16, but also maintains the ammonia and water mixture contained within the first conduit 24 in solution. Valve 47 is preferably a directional valve for directing the passage of the heated air into conduit 48.

The water heater 50 includes a tank 51 having a water inlet 52 and a water outlet 53. Two identical thermostats 54A and 54B are attached to the exterior of the tank 51 for monitoring the temperature of the water stored therein. The thermostats 54A and 54B cooperate with a pop-off valve 51A which communicates with the interior of the water tank 51 to prevent the water inside the tank 51 from overheating. The heated air passes from conduit 48 into a coiled conduit 55, which passes through the tank 51. The coiled conduit 55 is immersed in water inside the tank 51. As the heated air passes through the coiled conduit 55, the water inside the tank 51 is heated. While the temperature of the water heated by the water heater 50 may be varied, the temperature to which the water is ultimately heated within the water heater 50 is preferably 140° F.

The heated air exits the water heater 50 through a conduit 56, which is in fluid communication with coiled conduit 55. A first directional valve 57 is positioned within conduit 56 for directing the heated air into a second air return pipe 58B. Second air return pipe 58B is connected to air inlets 13A and 13B. A second directional valve 59 is positioned within second air return pipe 58B. Directional valve 59 directs the air through the second air return pipe 58B to air inlet manifolds 13A and 13B, and back into the frictional heating assembly 10, where the air is again reheated inside the enclosure 10 as described below in reference to FIG. 5.

The water heater 50 includes two supplemental heating elements 50A and 50B, which may be used individually or in combination with the coiled conduit 55 when necessary or desirable, or in providing heated water when the coiled conduit 55 is not in use.

The frictional heating and cooling system 10 may also be used to heat a building by heating the ambient air that passes through the air supply duct 30 either with or without the simultaneous operation of the water heater 50. In order to heat the ambient air passing through the air supply duct 30 without simultaneously operating the water heater 50, valves 22 and 47 are moved to prevent the heated air passing through first conduit 21 from passing into the second conduit 23 and into conduit 48. The heated air is instead directed through a heating conduit 60, which fluidly communicates with conduit 56. A directional valve 61 is positioned within heating conduit 60 and directs the heated air into conduit 56 away from directional valve 57. The heated air passes through conduit 56, into intake pipe 37, and through first and second heat exchanger conduits 38A and 38B, respectively, and into the second heat exchanger 36, where the heated air is used to heat the ambient air passing through the air supply duct 30. The heated air is then expelled from the second heat exchanger 36 through the first heat exchanger outlet 42A, where it encounters directional valve 43A and is directed through conduit 43 away from the housing 18 and through second air return pipe 58B back to air inlet manifolds 13A and 13B. The air also simultaneously exits the second heat exchanger 36 through a second heat exchanger outlet 42B, where it encounters dispatch valve 43B and is directed through conduit 44 away from the housing 18 and through first air return pipe 58A back to air inlet manifolds 13A and 13B.

Directional valve 41 is maintained in a closed position throughout this process not only to prevent ambient air from unnecessarily passing through the opening 39 into the intake pipe 37, but also to prevent heated air from escaping through the opening 39.

To heat the ambient air passing through the air supply duct 30 while simultaneously operating the water heater 50, valve 22 is positioned to prevent the heated air passing through first conduit 21 from passing into the second conduit 23, and to instead direct the heated air to valve 47, which in turn directs the heated air into conduit 48. The heated air moves along and then passes from conduit 48 into the coiled conduit 55. As described above, as the heated air passes through the coiled conduit 55, the water inside the tank 51 is heated.

After passing through the coiled conduit 55, the air travels through conduit 56, where it encounters directional valve 57. Valve 57 is moved to prevent the heated air from entering second air return pipe 58B. Valve 57 instead directs the heated air through conduit 56 to valve 61, which directs the air past heating conduit 60 and into the interior of intake pipe 37. Once inside intake pipe 37, the heated air passes through the respective first and second heat exchanger conduits 38A and 38B into the second heat exchanger 36. Second heat exchanger 36 transfers the heat from the heated air into the air supply duct 30, thereby heating the ambient air passing through air supply duct 30. The newly-heated ambient air then exits the air supply duct 30 through the opening 34. Directional valve 41 is again maintained in a closed position throughout.this process to prevent the heated air passing into the second heat exchanger 36 from being cooled by ambient air that would otherwise pass through the opening 40. Closing directional valve 41 also prevents the heated air from escaping from the intake pipe 37.

Two additional dispatch valves 43C and 55A are positioned within conduit 43 and on the downstream end of the coiled conduit 55, respectively. Dispatch valves 43C and 55A regulate the temperature, pressure, flow and direction of the air passing through conduit 43 and coiled conduit 55, respectively.

Figure 2:
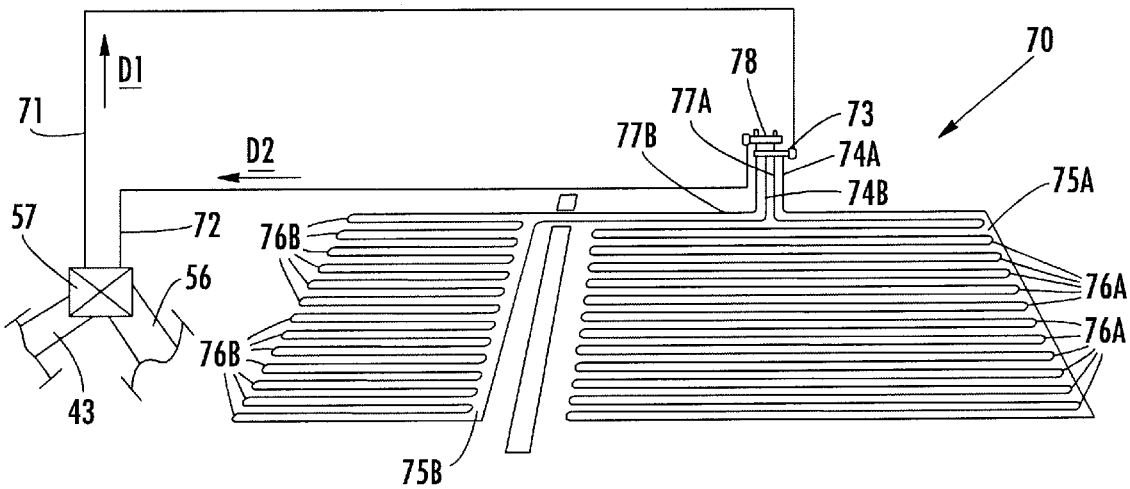
FIG. 2 is a perspective view of a radiating heater for use with the frictional heating and cooling system shown in FIG. 1.

Referring now to FIG. 2, the frictional heating and cooling system 10 may also include radiating heater 70 for heating the floor of a building or any other suitable surface. The radiating heater 70 includes radiator intake and outlet conduits 71 and 72, respectively, each of which are connected to and in fluid communication with valve 57. As is shown in FIG. 1, in order to heat a floor or other surface using the radiating heater assembly 70 without simultaneously operating the water heater 50, valves 22 and 47 are moved to prevent the heated air passing through first conduit 21, from passing into the second conduit 23 and into the conduit 48. The heated air is instead directed through heating conduit 60, and through directional valve 61 into conduit 56 away from the second heat exchanger 36.

Referring again to FIG. 2, the heated air encounters directional valve 57, and is directed into radiator intake conduit 71. The air passes through intake conduit 71 in the direction "$D_1$" shown and into a radiator supply manifold 73, which is connected by first and second radiator inlets 74A and 74B to first and second radiator panels 75A and 75B, respectively. First and second radiator panels 75A and 75B are formed from coiled tubes 76A and 76B. While the coiled tubes 76A and 76B may be formed from any suitable substance, the coiled tubes 76A and 76B are preferably formed from plastic. Furthermore, each coiled tube 76A and 76B may be of any suitable length and diameter.

As the heated air passes through the coiled tubes 76A and 76B, the heat is transferred from the air through the tubes 76A and 76B and radiates outside the tubes 76A and 76B into the adjacent surroundings. As discussed in detail with reference to FIGS. 3 and 4 below, such surroundings may include, but are not limited to concrete or wooden floors, or any other suitable surfaces. After the radiating heat transfer occurs, the air inside the tubes 76A and 76B is expelled from the radiator panels 75A and 75B through respective first and second radiator outlets 77A and 77B into a radiator return manifold 78. The air then travels from return manifold 78 through the radiator return conduit 72 in the direction "$D_2$" shown, where it again encounters directional valve 57. Valve 57 directs the air through second air return pipe 58B back to the air inlet manifolds 13A and 13B.

The radiating heater assembly 70 may also be used to heat a floor or other surface while simultaneously using the hot water heater 50. As described with reference to FIG. 1 above, during this process, valve 22 is positioned to prevent the heated passing from the enclosure 11 through conduit 21 from traveling into the second conduit 23. Valve 22 instead directs the heated air to valve 47, which in turn directs the heated air into conduit 48. The air then travels from conduit 48 into and through the coiled conduit 55, and heats the water inside the tank 51.

Referring again to FIG. 2, after traveling through the coiled conduit 55 and heating the water inside the tank 51, the heated air travels through conduit 56 to valve 57. Valve 57 directs the air into radiator intake conduit 71. The air then passes through radiator supply manifold 73 and the radiator inlets 74A and 74B, into the coiled tubes 76A and 76B of the first and second radiator panels 75A and 75B, respectively. The heat is then transferred from the air through the tubes 76A and 76B and radiates outside the tubes 76A and 76B into the adjacent surroundings. After the radiating heat transfer occurs, the air inside the tubes 76A and 76B is expelled through respective first and second radiator outlets 77A and 77B into the radiator return manifold 78, where it travels through the radiator return conduit 72 back to directional valve 57. The air is directed by valve 57 through the second air return pipe back to the air inlet manifolds 13A and 13B.

Figure 3:
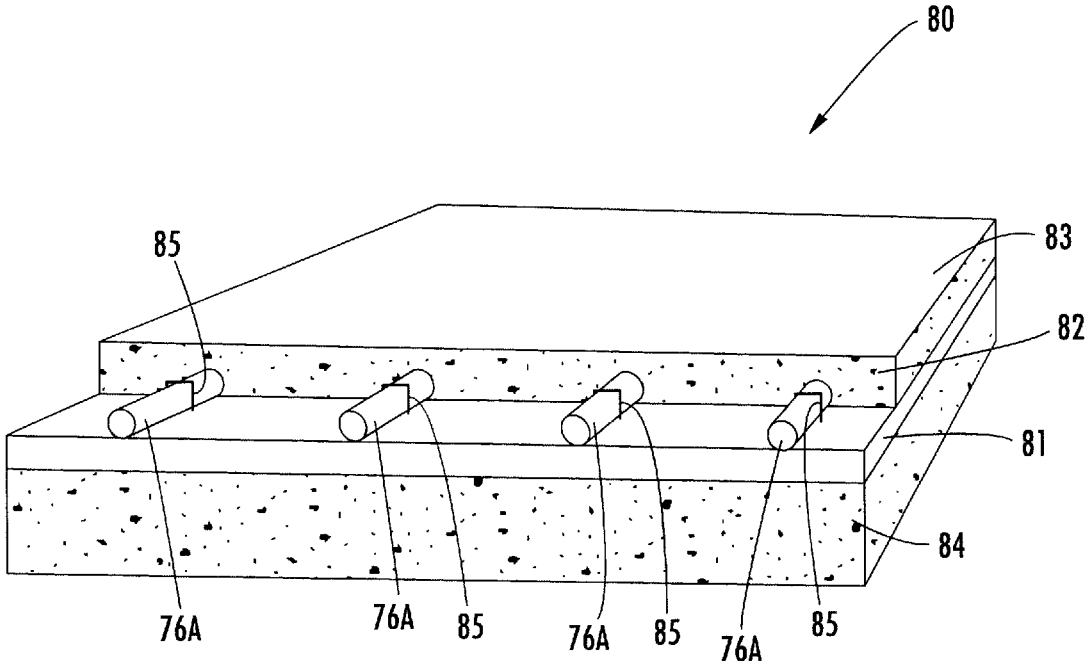
FIG. 3 is a cut-away perspective View of the radiating heater shown in FIG. 2 in use with a concrete flooring assembly.
Figure 4:
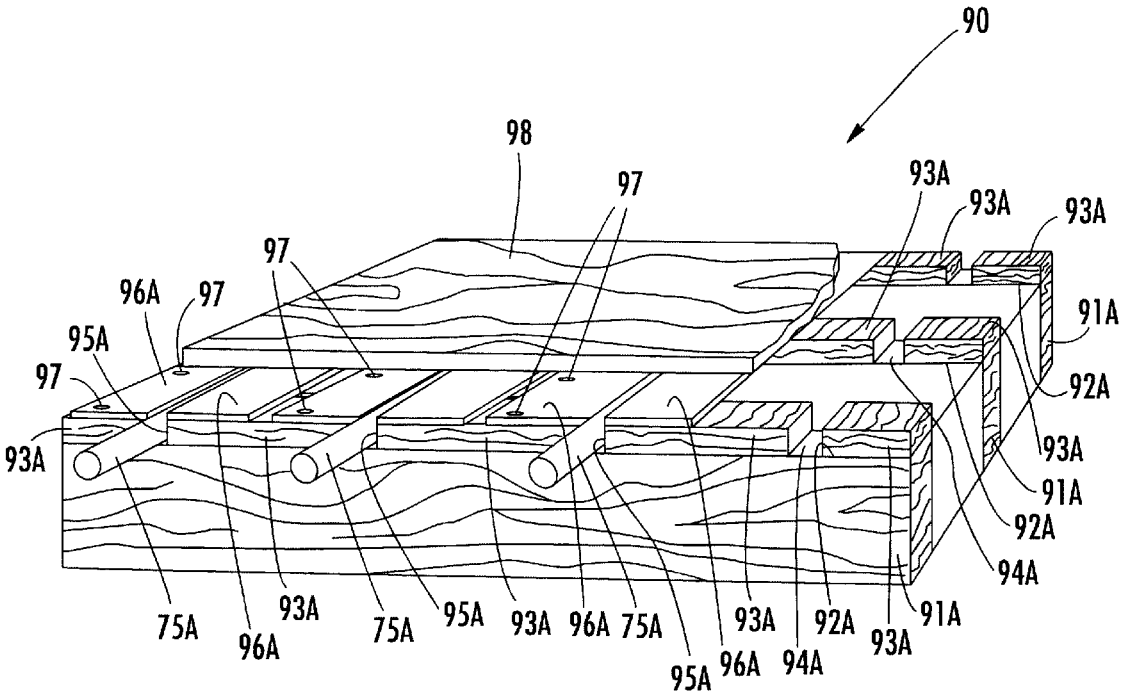
FIG. 4 is a cut-away perspective view of the radiating heater shown in FIG. 2 in use with a wooden flooring assembly.

Referring now to FIGS. 3 and 4, the radiating heater assembly 70 is shown in use with two different types of floors. FIG. 3 shows the radiating heater assembly 70 in use with a concrete flooring assembly 80. The concrete flooring assembly 80 includes an insulation layer 81 positioned between an overpour layer 82 having an upper surface 83, and a lower concrete slab 84.

Coiled tubes 76A are shown in FIG. 3 as a representative example of the manner in which the coiled tubes 76A and 76B are positioned within the concrete flooring assembly 80. Coiled tubes 76A are positioned on top of the insulation layer 81, and are covered and held in place by the overpour layer 82. The coiled tubes 76A are also secured to the insulation layer 81 by staples 85.

As the heated air passes through the tubes 76A, heat is transferred by radiation through the tubes 76A and into the overpour layer 82. The heat continues to travel by radiation through the overpour layer 82 to the upper surface 83. The insulation layer 81 may be formed from any suitable insulating material, including but not limited to fiberglass or foam, and prevents the heat radiating from the tubes 76A from traveling into the concrete slab 83.

Referring now to FIG. 4, the radiating heat assembly 70 is shown in use with a wooden flooring system 90. Coiled tubes 76A are shown as a representative example of the manner in which coiled tubes 76A and 76B are positioned within the wooden flooring system 90. The flooring system 90 includes a plurality of floor joists 91A, each of which has an upper edge 92A. A number of equally-spaced furring strips 93A are attached to the edges 92A, and define openings 94A which collectively define a number of channels 95A which extend perpendicularly to the floor joists 91A. Each tube 75A is positioned within a respective one of the channels 95A. A layer of heat emission plates 96A covers the tubes 75A and furring strips 93A. The heat emission plates 96A are attached to the furring strips 93A by staples 97, and are covered by a subfloor 98.

Although the heat emission plates 96A may be formed from any suitable material, the heat emission plates 96A are preferably formed from a substance that readily conducts heat, such as aluminum.

In order to heat the subfloor 98, heat is transferred from the air traveling through the pipes 75A by radiating through the pipes 75A and into the emissions plates 96A. The heat is evenly distributed across the plates 96A, and is then transferred into the subfloor 98. An insulating layer 98 is positioned beneath the plates 96A and between each floor joist 91A to ensure that the heat passing through the pipes 75A travels toward the plates 96A and the subfloor 98.

Figure 5:
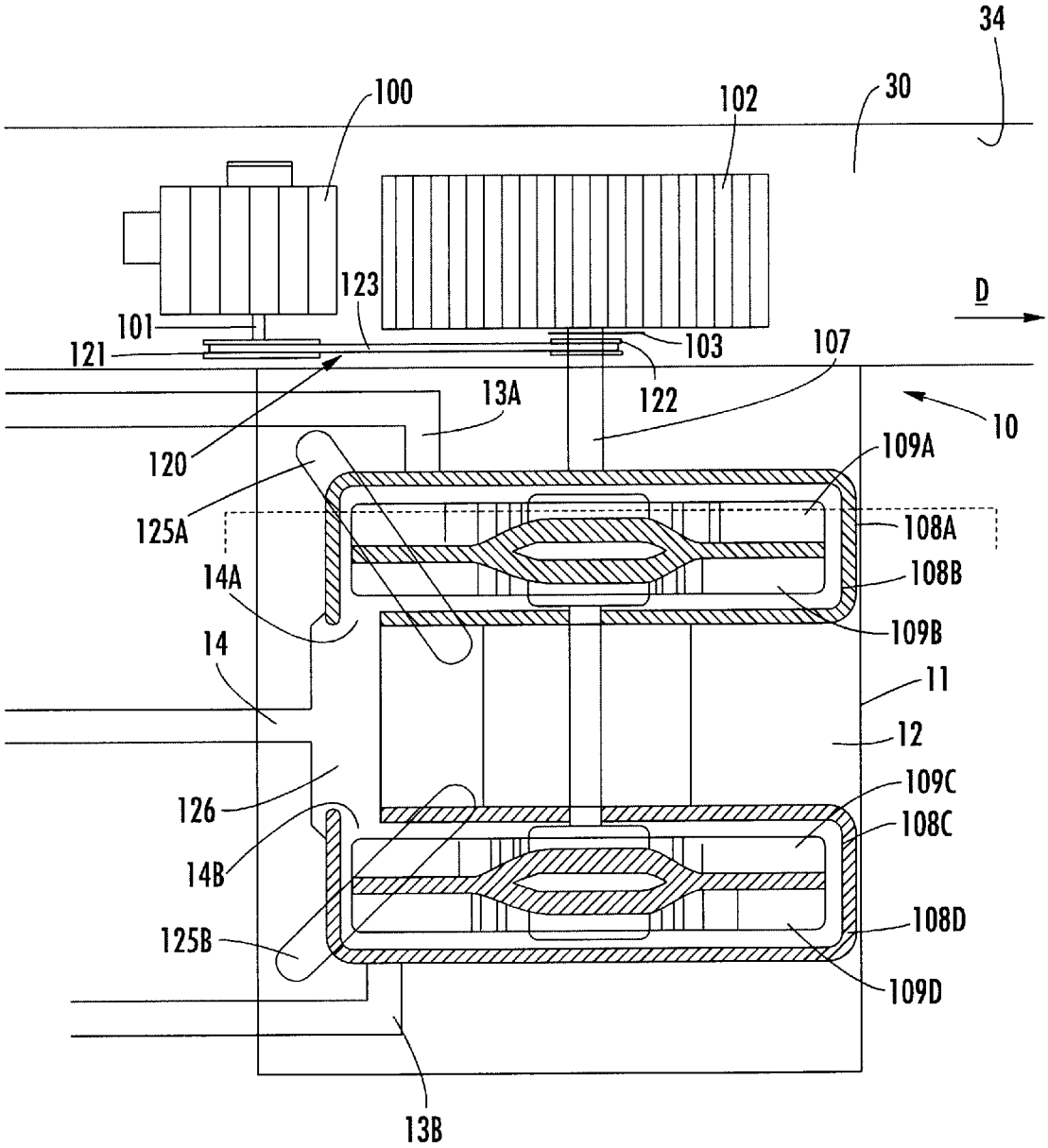
FIG. 5 is a partial view of the frictional heating system shown in FIG. 1.

Referring now to FIG. 5, the manner in which the air is heated within the enclosure 11 is shown. The frictional heating and cooling system 10 includes an electric motor 100 mounted on a shaft 101 positioned within the air supply duct 30 downstream from an intake fan 102. The intake fan 102 is mounted on a common shaft 107, and is likewise positioned within the air supply duct 30. Common shaft 107 extends into the interior 12 of the enclosure 11 and through four identical turbine housings 108A, 108B, 108C and 108D. Four identical turbines 109A, 109B, 109C and 109D are also carried on the common shaft 107. Each turbine 109A, 109B, 109C and 109D is positioned within turbine housings 108A, 108B, 108C and 108D, respectively.

The motor 100 is connected to the intake fan 102 by a head-and-tail pulley assembly shown generally at reference numeral 120. The head-and-tail pulley assembly 120 includes a first pulley 121 connected to the shaft 101 adjacent the motor 100. A second pulley 122 is connected to the common shaft 107 adjacent the intake fan 102. First and second pulleys 121 and 122, respectively, are interconnected by a belt 123.

Electric motors included in prior art frictional heating systems are typically positioned within the same enclosure with a single turbine, and are used to drive the turbine to frictionally heat the air inside the enclosure. Positioning the motor and the turbine within the same enclosure is problematic in that the increased heat generated from the rotating turbine and the operating motor is compounded within the enclosure and causes the motor to overheat. As shown in FIG. 5, this problem is avoided by positioning the motor 100 outside of the enclosure 11 and within the air supply duct 30, where the motor is cooled by the air passing through the air supply duct 30, and thus does not overheat.

Interconnecting the shaft 101 and the common shaft 107 with the head-and-tail pulley assembly 120 allows the motor 100 to drive the intake fan 102 and the turbines 109A, 109B, 109C and 109D simultaneously. The motor 100 is thus used more efficiently than motors employed in prior art frictional air heating devices. The motor 100 of the present invention drives the head-and-tail pulley assembly 120, which in turn causes the common shaft 107 and intake fan 102 to rotate and draw ambient air through the air supply duct 30 in the direction "D" shown, while the turbines 109A, 109B, 109C and 109D simultaneously rotate inside the housings 108A, 108B, 108C and 108D, which causes air passing through the enclosure 11 to be frictionally heated.

The frictional heating assembly 10 may alternatively be operated without using the intake fan 102. As is shown in FIG. 5, a clutch mechanism 103 is mounted on the common shaft 107 between the intake fan 102 and the second pulley 122, and may be used to manually disengage the intake fan 102 from the common shaft 107.

Although the air passing through the housings 108A, 108B, 108C and 108D may be heated to any predetermined temperate, the air is preferably heated within the enclosure 11 to reach a total temperature between 140° F. and 460° F. As is shown in FIG. 2, turbine housings 108A, 108B, 108C and 108D are in fluid communication with each other and with the interior 12 of the enclosure 11. Air inlet manifolds 13A and 13B fluidly communicate with turbine housings 108A and 108D, respectively, to allow air to be drawn into the turbine housings 108A and 108D. Air entering the turbine housing 108A from air inlet manifold 13A is circulated by turbine 109A around housing 108A and is frictionally heated to a first predetermined temperature. The air then passes from housing 108A through a cross-return pipe 125A and into housing 108B, where it is circulated by turbine 109B and is heated to a second predetermined temperature. Air entering the turbine housing 108D from air inlet manifold 13B is similarly circulated by turbine 109D around housing 108D to be frictionally heated to a third predetermined temperature, and is then expelled from housing 109D into a cross-return pipe 125B. The air passes from cross-return pipe 125B into turbine housing 108C, where it is circulated by turbine 109C and heated to a fourth predetermined temperature. After being heated within the housings 108B and 108C, the air passes through outlet openings 14A and 14B, respectively, and into a chamber 126 located within the interior 12. The heated air then exits the enclosure 11 through air outlet manifold 14, and is used to heat water, heat a building, and/or cool the building as described above. See FIG. 1.

Although the first, second, third and fourth predetermined temperatures can be any suitable temperatures, the first predetermined temperature is preferably 200° F. The second predetermined temperature is preferably 320° F. The third and fourth predetermined temperatures are preferably 200° F. and 320° F., respectively. The temperature of the air exiting the from the chamber 126 may be heated to any suitable temperature; however, in the embodiment shown in FIG. 1, by the time the air exits the chamber 126, it has preferably been heated to a temperature of 460° F.

Figure 6:
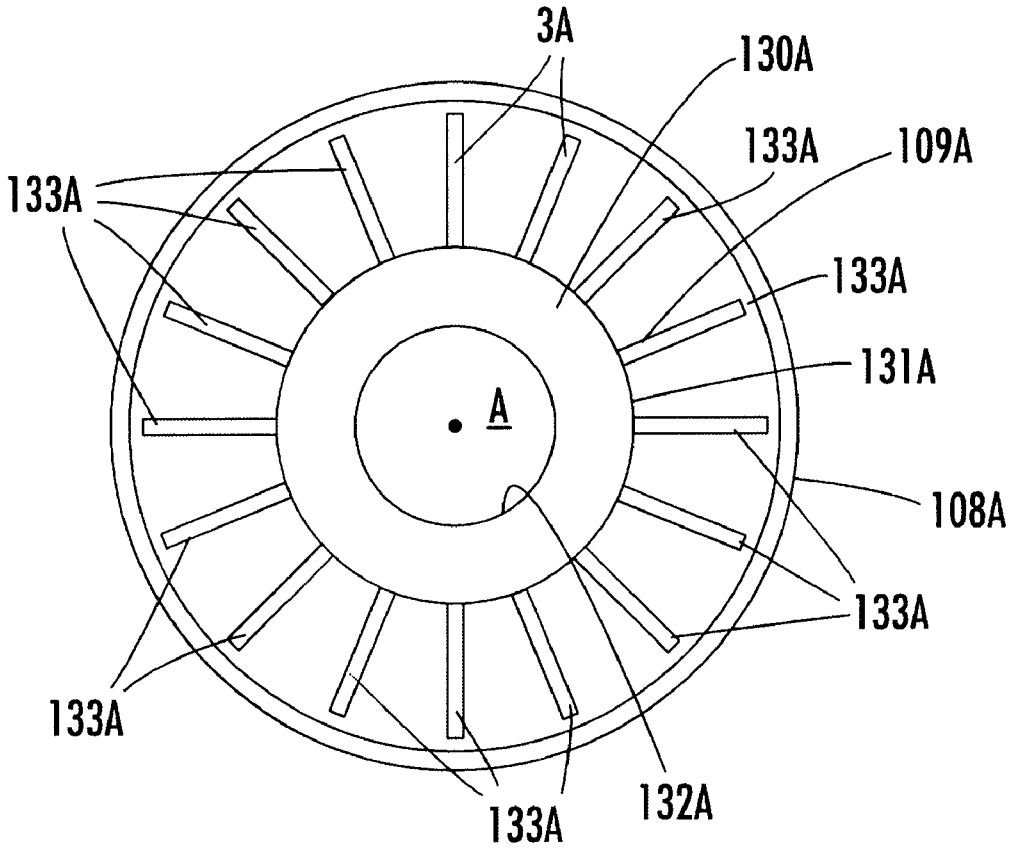
FIG. 6 is a cross-sectional view of one of the turbines taken through Line 6—6 of FIG. 2.

Referring now to FIG. 6, the interior structure of one of the turbines is shown. Each turbine 109A, 109B, 109C and 109D is identical; therefore, the interior structure of turbine 109A is used as a representative example of the interior structure of turbines 109B, 109C and 109D, respectively. As is shown in FIG. 6, turbine 109A includes an annular base 130A having exterior walls 131A. The base 130A is preferably formed from aluminum cast around steel. The base 130A defines a bore 132A through which the common shaft 107 is received and is connected to the base 130A. A series of identical, integrally formed vanes 133A are connected to and extend radially outwardly from exterior wall 131A. The vanes 133A lie in radially-extending planes that intersect the axis "A" of the turbine 109A. This radial orientation of the vanes 133A with the absence of any pitch or incline permits the turbine 109A to operate at a high rate of speed for centrifugally moving and frictionally heating the air without causing undue strain on the motor 100, regardless of the pressure conditions within the air inlet manifolds 13A and 13B, the air outlet manifold 14, or the enclosure 11.

The common shaft 107 is driven by the motor 100, which causes the base 130A and vanes 133A rotate within the housing 108A and air to be drawn through the air inlet manifold 13A and into the housing 108A. Once the air is confined within housing 108A, the movement of the vanes 133A circulates the air around the housing 108A and causes the air to be frictionally heated therein prior to flowing through cross-return pipe 125A into housing 108B. See FIG. 5.

Figure 7:
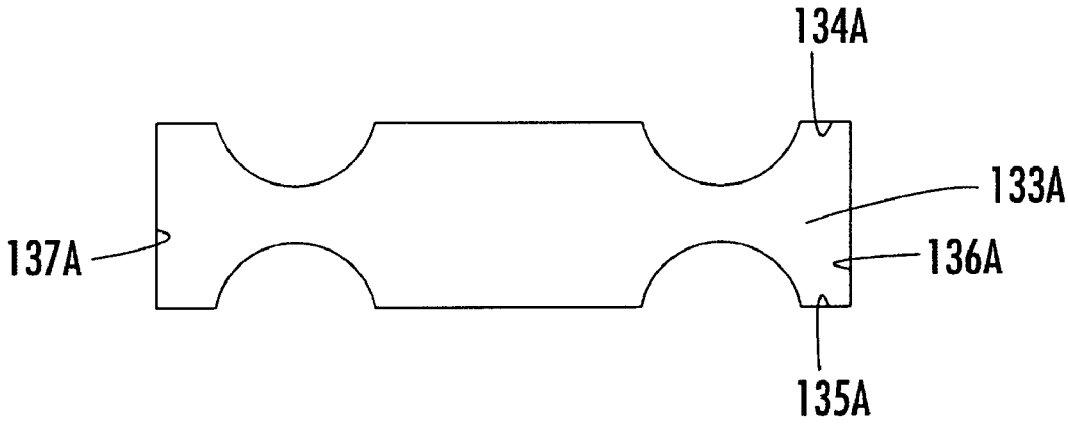
FIG. 7 is a side view of one of the vanes included in the turbines used in the frictional heating assembly of the present invention.
Figure 8:
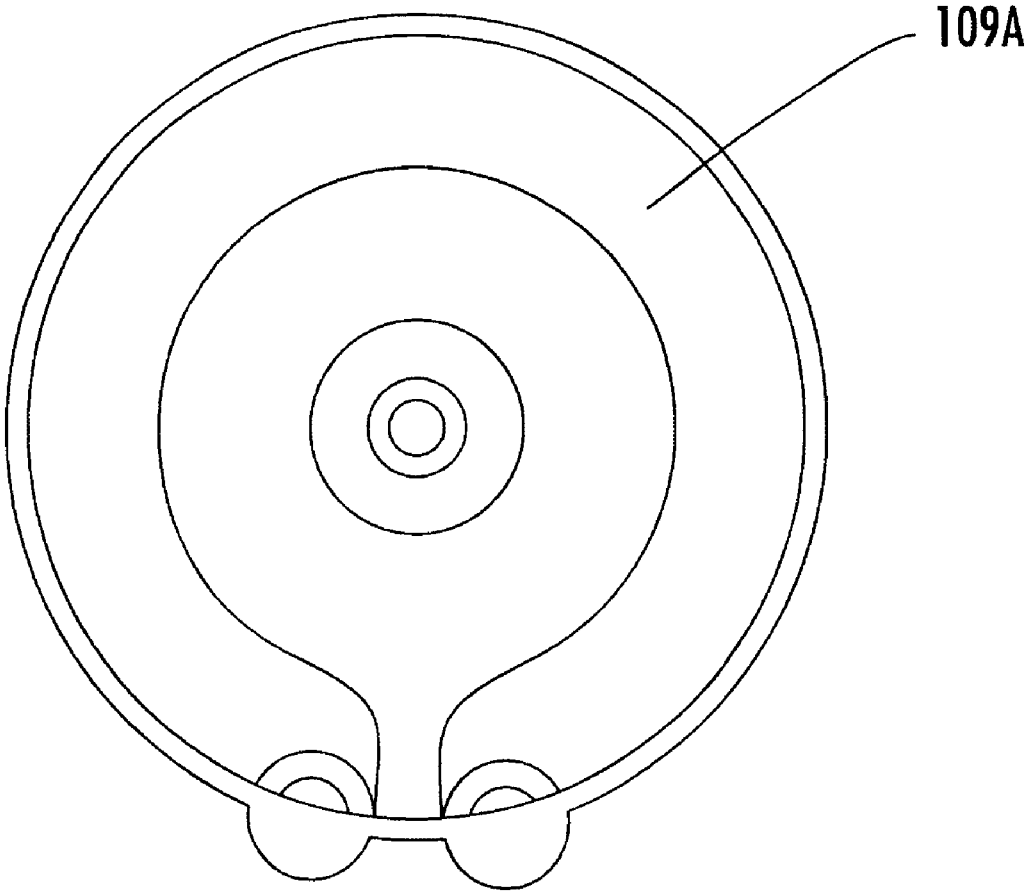
FIG. 8 is a side view of the outside of one of the turbine housings used in the frictional heating assembly of the present invention.

Referring now to FIG. 7, the shape of a single vane 133A is shown. Unlike conventional fan blades or vanes which are generally curved or inclined, each vane 133A is flat and has two pairs of oppositely facing side edges 134A and 135A, and 136A and 137A, respectively. A plurality of concave indentations 138A are defined along the length of each side edge 134A and 135A. Including the concave indentations 138A along the side edges 134A and 135A causes a vacuum to be created within the housing 108A when the turbine 109A rotates, which causes the air circulating inside the housing 108A to be heated at an increased rate. The exterior of housing 108A is shown in FIG. 8, and is identical to the exteriors of housings 108B, 108C and 108D.

In the embodiment described above, a minimum of four turbines and respective turbine housings are required. However, as few as two turbines and respective turbine housings may be used, and there is no theoretical maximum number of turbines and accompanying turbine housings which may be utilized. The turbine housings can be grouped together or otherwise positioned within the enclosure in any suitable arrangement, and can be sequenced so that the air is passed or recirculated in parallel, in series, or in a combination thereof, through any two, three, four or more of the turbine housings for being frictionally heated therein. Furthermore, although the embodiment described above is shown in use with a water heater, the frictional heating assembly of the present invention may also be used with heating and cooling systems which do not include an interconnected water heater.

A frictional heating assembly for use with a water heater, air conditioner and heating unit has been disclosed. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A frictional heating system communicating with an air supply duct to heat and cool air in a building, comprising:

(a) an enclosure defining an interior, two air inlets, and at least one air outlet therein communicating with said interior of said enclosure for permitting air to flow therethrough;

(b) a plurality of turbines carried on a first shaft for rotation therewith, each of said turbines positioned within the enclosure for drawing air into the enclosure and frictionally heating the air therein;

(c) a plurality of turbine housings positioned within the enclosure, each of said turbine housings defining an interior in fluid communication with the air inlet for permitting air to flow into the turbine housings and the air outlet for permitting the air to flow out of the turbine housings, wherein each of said turbines is positioned within a respective one of the turbine housings for drawings air into the respective turbine housing interior and frictionally heating the air therein;

(d) a motor assembly including:

(i) a motor carried on a second shaft operatively connected to said first shaft and positioned outside the enclosure for driving the first shaft and turbines mounted thereon; and (ii) an intake fan mounted on the first shaft and positioned within the air supply duct for drawing ambient air therethrough;

(e) a first conduit in fluid communication with said air outlet, a water heater and an air conditioning system for moving frictionally-heated air from the air outlet to one or the other of said water heater and said air conditioning system; and (f) a first directional valve positioned in said first conduit for selectively moving frictionally-heated air from the air outlet to one or the other of the water heater and the air conditioning system.

2. A frictional heating system according to claim 1, wherein said motor assembly is:

(i) interconnected by a head and tail pulley assembly to the first shaft for permitting the motor to drive the first shaft, turbines and intake fan; and (ii) positioned upstream from the intake fan within the air supply duct for being cooled by the ambient air drawn therethrough.

3. A frictional heating system according to claim 2, and further comprising at least one turbine conduit selectively communicating with said plurality of turbine housings for directing air from the air inlet from an upstream side to a downstream side of each turbine housing, to frictionally heat the air therein to a predetermined temperature.

4. A frictional heating system according to claim 3, and further comprising at least one recirculation conduit selectively communicating with the plurality of turbine housings for directing the air from the turbine housings and into the air outlet.

5. A frictional heating system according to claim 4, wherein each of said turbines includes a series of radially-extending vanes for creating and maintaining a flow of air within each turbine housing upon rotation of the turbine by the first shaft, thereby frictionally heating the air therein.

6. A frictional heating system according to claim 5, wherein each of said radially-extending vanes includes contoured edges for creating a vacuum inside each turbine housing upon rotation of the turbines by the first shaft, thereby increasing the rate at which the air is frictionally heated therein.

7. A frictional heating system according to claim 6, wherein said turbines frictionally heat the air to a temperature between 140° F. and 460° F.

8. In a frictional heating system according to claim 7, and further comprising a heat exchanger for selectively pre-cooling air before the air enters the air-cooling condenser coil and pre-heating air before the air is returned to the enclosure, said heat exchanger positioned within the air supply duct upstream from said motor assembly and defining an interior in fluid communication with an air intake conduit system fluidly connected the air outlet for receiving air therefrom.

9. A frictional heating system according to claim 8, wherein said interior of the heat exchanger is in fluid communication with an air outlet conduit system fluidly connected to and adapted for selectively directing air out of the heat exchanger to the air cooling condenser coil or to air inlet of the enclosure.

10. A frictional heating system according to claim 9, wherein said air intake conduit system comprises first and second intake conduits in fluid communication with an ambient air intake conduit for drawing ambient air into said heat exchanger and to the air outlet of the frictional heating assembly for receiving frictionally heated air therefrom.

11. A frictional heating system according to claim 10, wherein said air intake conduit system further comprises an air intake filter positioned within said ambient air intake conduit for filtering the ambient air passing therethrough.

12. A frictional heating system according to claim 11, wherein said air intake conduit system further comprises a second directional valve positioned within the ambient air intake conduit downstream from said air intake filter for selectively introducing ambient air into said first and second intake conduits.

13. A frictional heating system according to claim 12, wherein said air outlet conduit system comprises a first return conduit including a third directional valve positioned therein for selectively directing air from said heat exchanger, said first return conduit and third directional valve fluidly selectively communicating with:

(i) a first return duct connected to and in fluid communication with the air inlet for returning air to the enclosure; and (ii) an intake duct connected to and in fluid communication with the air cooling condenser coil in the air conditioning system for preheating the air, the air cooling condenser coil connected to and fluidly communicating with a second return duct connected to and fluid communication with the air inlet for returning the preheated air to the enclosure.

14. A frictional heating system according to claim 13, wherein said outlet conduit system further comprises a second return conduit in fluid communication with said second return duct, said second return conduit including a first dispatch valve positioned therein for selectively opening the second return conduit for permitting air to flow through the second return duct and into the air inlet, thereby returning the preheated air to the enclosure.

15. A frictional heating system according to claim 14, wherein said intake fan includes a clutch mechanism for selectively disengaging the fan from the motor assembly, thereby preventing the flow of ambient air through the air supply duct.

16. A frictional heating system according to claim 15, and further comprising a fourth directional valve positioned within the second return duct between the air-cooling condenser coil and the second return conduit for controlling the direction of air flowing through the second return duct.

* * * * *

UNITED STATES PATENT AND TRADEMARK OFFICE

CERTIFICATE OF CORRECTION

PATENT NO. : 6,547,153 B1
DATED : April 15, 2003
INVENTOR(S) : Davis, Maxie C.

It is certified that error appears in the above-identified patent and that said Letters Patent is hereby corrected as shown below:

Column 12,
Line 49, delete “drawings” and insert -- drawing --.

Column 13,
Line 33, delete the period after the “F” in “140° F.”.

Signed and Sealed this

Twenty-first Day of October, 2003

JAMES E. ROGAN
*Director of the United States Patent and Trademark Office*